US006066016A

United States Patent [19]

Yonover

[11] Patent Number: 6,066,016

[45] Date of Patent: May 23, 2000

[54] INFLATABLE TRANSPORTABLE WATER CRAFT FOR SURVIVAL OR RECREATIONAL APPLICATIONS

[76] Inventor: Robert N. Yonover, 219 Koko Isle, Suite 602, Honolulu, Hi. 96825

[21] Appl. No.: 09/187,732

[22] Filed: Nov. 9, 1998

Related U.S. Application Data

[60] Provisional application No. 60/065,162, Nov. 12, 1997.

[51] Int. Cl.[7] ..... B63B 35/58

[52] U.S. Cl. ..... 441/40

[58] Field of Search ..... 441/7–10, 35, 441/40–42, 65, 66, 74, 125, 129–132, 136, 80; 5/455; 114/345

[56] References Cited

U.S. PATENT DOCUMENTS

| | | | |
|---|---|---|---|
| 1,178,874 | 4/1916 | Ramos . | |
| 1,259,201 | 3/1918 | Barringer . | |
| 2,064,128 | 12/1936 | Smithers et al. | 441/66 |
| 2,743,510 | 5/1956 | Mauney et al. | 114/345 |
| 3,155,992 | 11/1964 | Shewmake et al. . | |
| 3,425,071 | 2/1969 | Frieder et al. . | |
| 3,730,247 | 5/1973 | White . | |
| 4,187,570 | 2/1980 | De Simone | 441/40 |
| 4,457,730 | 7/1984 | Foster et al. . | |
| 4,547,919 | 10/1985 | Wang | 5/455 |
| 4,573,933 | 3/1986 | Cameron . | |
| 4,577,816 | 3/1986 | Foster . | |
| 4,725,252 | 2/1988 | McNeil | 441/89 |
| 4,750,447 | 6/1988 | Spinosa et al. . | |
| 4,840,592 | 6/1989 | Anderson | 441/135 |
| 4,959,034 | 9/1990 | Wass | 441/41 |
| 5,284,453 | 2/1994 | Kun . | |
| 5,351,637 | 10/1994 | Brenckmann | 441/66 |
| 5,362,270 | 11/1994 | Hanson et al. | 441/75 |
| 5,421,287 | 6/1995 | Yonover | 441/83 |
| 5,468,167 | 11/1995 | Givens . | |
| 5,729,840 | 3/1998 | Wu . | |

FOREIGN PATENT DOCUMENTS

| | | | |
|---|---|---|---|
| 2666297 | 3/1992 | France | 441/80 |

*Primary Examiner*—Ed Swinehart
*Attorney, Agent, or Firm*—Shlesinger, Arkwright & Garvey LLP

[57] ABSTRACT

A water craft for survival or recreational purposes, comprises an inflatable elongate housing that provides a platform and has an internal supporting structure for rigidity and a fin or multitude of fins Ry for stability and tracking purposes as the survivor paddles the water craft by arm motion. The craft is stowed in a compact pouch when not in use and inflated by compressed gases and/or a manual hand pump to sustain the requisite partial pressures of the inflatable water craft. A thermal protective covering with brightly colored pigmentation and retro-reflective and IR-reflective surfaces is provided to protect the survivor from the elements and enhance his visibility. A non-skid surface on the platform enables the survivor to lay on top of the water craft without slipping off. A bright orange colored elongate SEE/RESCUE (trademark) streamer is provided with the water craft for continuous passive emergency signaling purposes to enable search parties to locate the survivor. An attachable leg leash is provided to keep the water craft from separating from the survivor in rough seas and/or wind conditions. A compass is built into the craft to provide direction to the survivor's mobility. In addition to survivor applications, the water craft can be used for water recreational purposes, such as surfing and paddling.

27 Claims, 6 Drawing Sheets

INFLATABLE TRANSPORTABLE WATER CRAFT FOR SURVIVAL OR RECREATIONAL APPLICATIONS

RELATED APPLICATION

This is a nonprovisional application which claims priority from provisional application Ser. No. 60/065,162, filed Nov. 12, 1997.

FIELD OF THE INVENTION

The present invention relates generally to devices to help provide flotation, protection, mobility, and signaling capability to persons stranded at sea and particularly to devices that can inflate into a paddling water survival craft that can be stowed on a person, boat, aircraft, or the like, until needed in an emergency situation or for use as a recreational device.

BACKGROUND OF THE INVENTION

The present state-of-the-art in recreational and military one-person life rafts consist of circular or elongate-shaped structures that the survivor places his body within. The rafts are subject to the uncontrollable wind and water currents and, therefore, the survivor has no chance of moving the raft towards a land mass or an approaching ship or aircraft for visual location and subsequent rescue. The present rafts also provide little or no protection against the elements, resulting in severe solar ultraviolet exposure and loss of body heat resulting from cold air/water masses. Furthermore, the most commonly used military one-person life raft is designed for the survivor to be submerged in water at all times. The current one-person life rafts also provide no integral means for simply providing a continuous emergency signal to alert search parties of his whereabouts.

My invention enables a person that finds himself lost at sea to quickly and simply attain flotation, protection, mobility, and signaling capabilities to increase his chances of sustaining his life functions and achieving a safe rescue from his emergency situation. The invention described herein can also be used for recreational purposes wherein water flotation and mobility will be provided in a simple and inexpensive manner. When not in use, the device can be stowed or carried in a compact fashion.

OBJECTS AND SUMMARY OF THE INVENTION

It is an object of my invention to provide a one-person inflatable water craft which, when deployed, will provide a life support module that will increase a person's chances of surviving the condition of being lost at sea.

It is another object of my invention is to provide an inflatable survival craft that can be paddled by a survivor's arm movements in order to achieve mobility to get to land or in the path of a search boat or plane.

It is still another object of my invention is to provide a survival craft that provides an extremely rigid structure when inflated with air, thereby providing a stable platform for supporting the user when paddling in a prone face-down position.

It is yet another object of my invention is provide an inflatable survival craft that includes a thermal protective covering to protect the survivor from sun exposure and cold temperatures, thereby keep the survivor's body temperature from becoming too hot or too cold that could lead to a serious life threatening condition.

It is another object of my invention is to provide an inflatable survival craft that includes a visual locating device in the form of a long brightly colored streamer that will float on the water to make the survivor more visible to search parties.

It is another object of my invention is to provide a one-person survival craft that can be folded when deflated and stowed in a protective case.

It is still another object of my invention is to provide an inflatable craft that can be used for paddling and/or wave surfing for recreational purposes.

In summary, my invention provides an inflatable one-person survival craft that enables a survivor to paddle to safety, while providing thermal protection for his life functions and continuous passive emergency signaling to alert search parties of their location. The survival craft may be automatically deployed from its compact stowage case by a compressed gas source. A manual hand pump is provided as a source for alternative and supplemental air pressure. The survival craft is constructed with an internal structure, such as a drop-stitch neoprene layered material, that provides for an extremely rigid structure when pressurized with air.

In broad sense, my invention is a water craft, comprising an inflatable, elongate and rigid housing when inflated, having substantially parallel top and bottom walls. The top wall includes a flat surface configured to support a user lying in a prone face-down position. The housing is configured such that a user in the prone face-down position can paddle alternately with his hands toward a direction.

These and other objects of the present invention will become apparent from the following detailed description.

BRIEF DESCRIPTIONS OF THE DRAWINGS

DETAILED DESCRIPTION OF THE INVENTION

Figure 1:
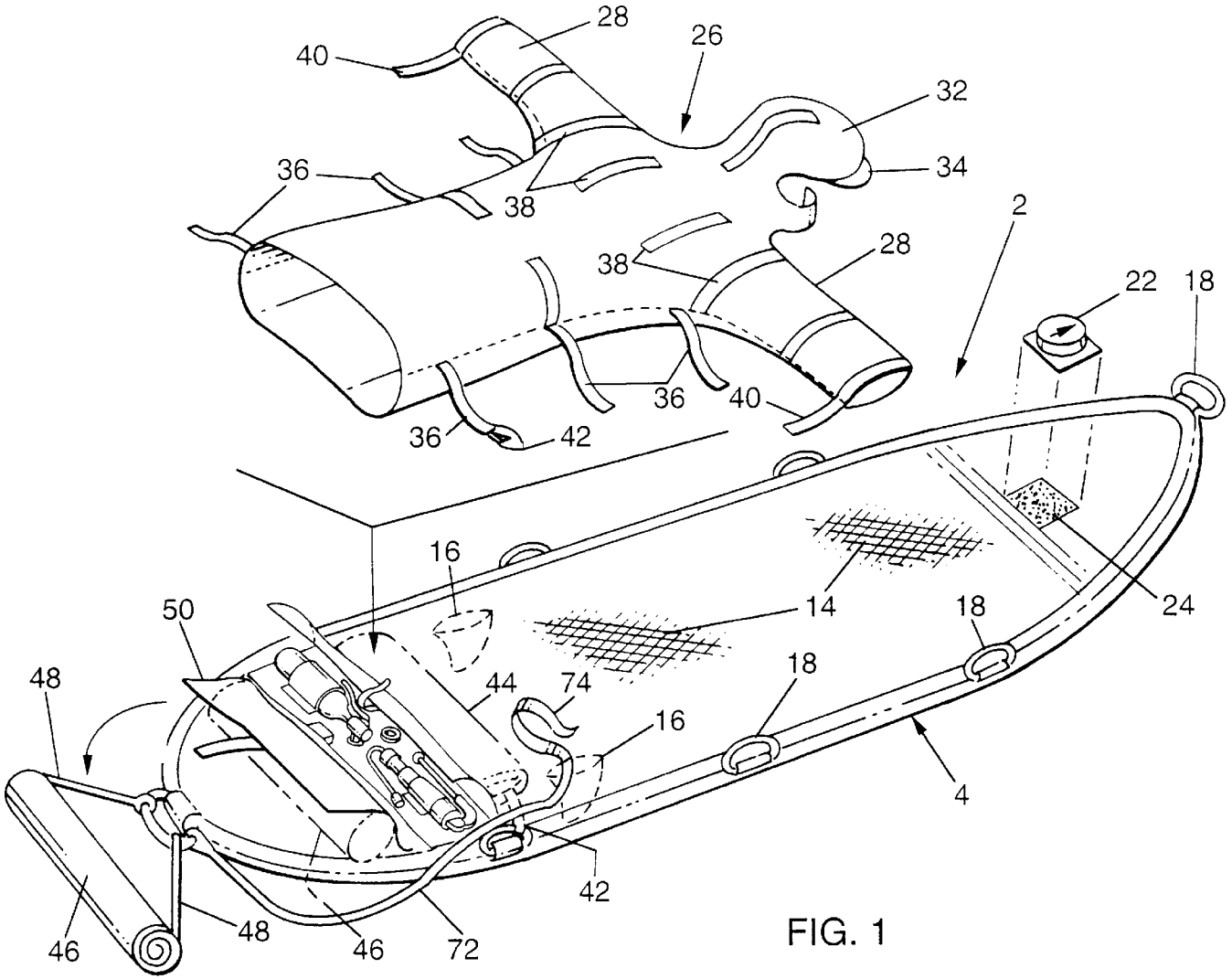
FIG. 1 is a perspective view of a one-person survival craft made in accordance with the present invention.
Figure 2A:
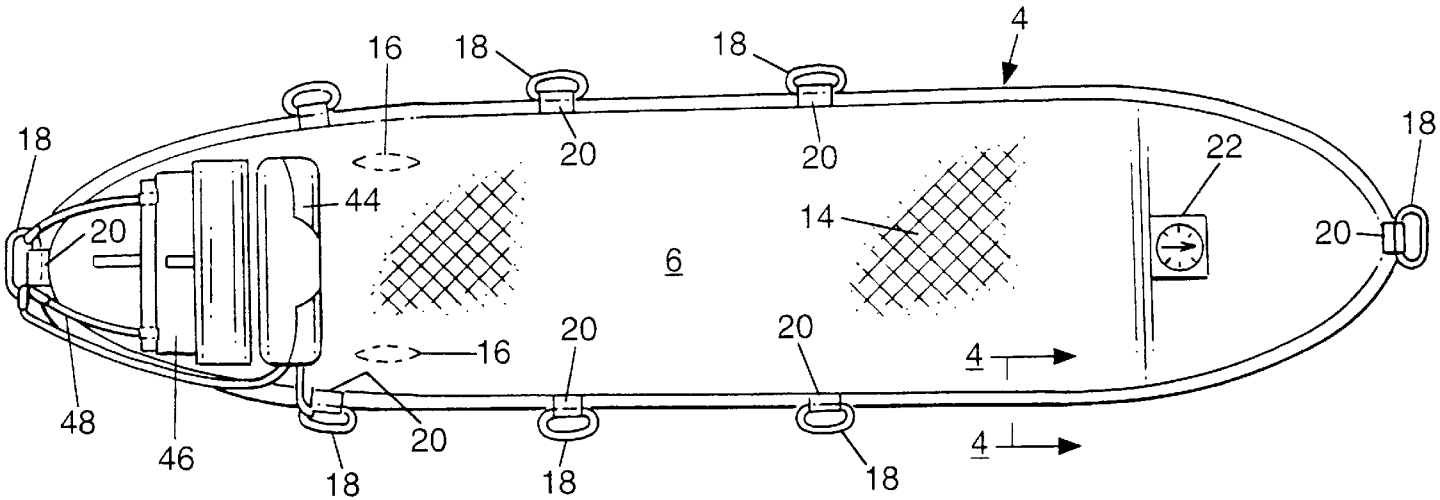
FIGS. 2A and 2B are top and side elevational views of the one-person survival craft of FIG. 1.
Figure 2B:
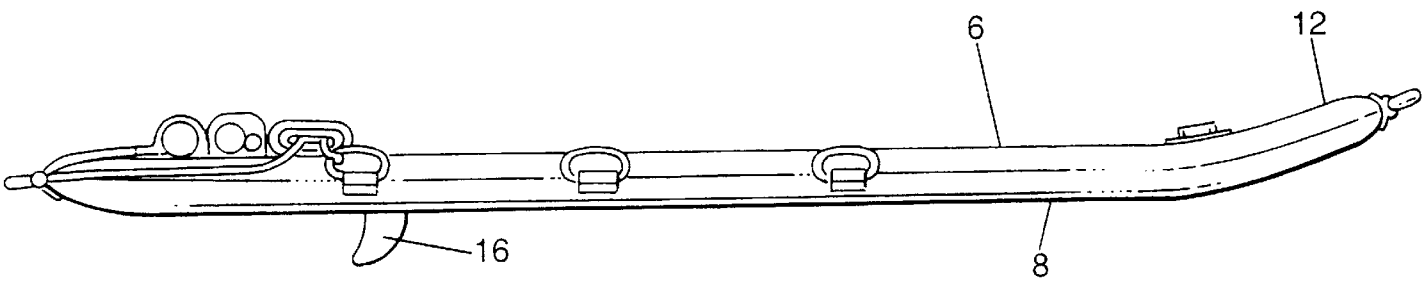
Figure 3:
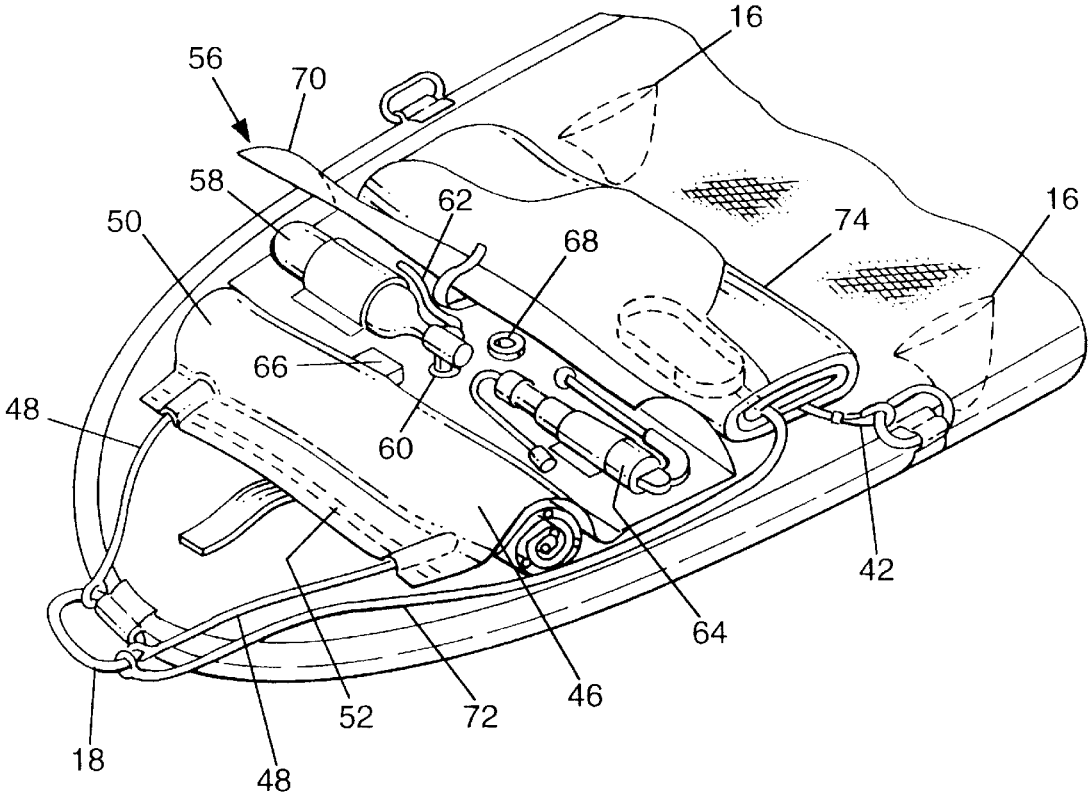
FIG. 3 is a fragmentary enlarged perspective view of the rear portion of the craft of FIG. 1.

A survival water craft 2 is disclosed in FIG. 1. The craft 2 includes an inflatable, elongate and rigid housing 4 when inflated, having a top wall 6 and a bottom wall 8, as best shown in FIGS. 2A and 2B. The top and bottom walls 6 and 8 are joined together along their periphery by conventional means to provide an airtight construction. The housing 4 may be made of nylon material, PVC, urethane or other materials that can be joined together at the edges by heat sealing for mass production purposes. The housing 4 is configured such that a user lying in a prone position on the top wall 6 would be able to reach over the sides 10 of the craft to paddle alternately with his hands toward land or shipping lanes. The housing 4 has front portion 12 which is at an angle with the rest of the housing to advantageously allow the craft to skim over the water. The top wall 6 includes a non-skid material 14 to minimize the user from sliding off the (Ry) craft. A pair of fins 16 are secured to the bottom wall 8 at the rear portion of the housing 4 to provide for directional stability and tracking purposes as the user paddles the water craft by arm motions, similar to paddling a surfboard. Any number of fins 16 may be used. For example, a single fin disposed centrally at the bottom rear end of the housing 4 may be used.

A plurality of attaching rings 18 are secured at a number of places along the periphery of the housing 4 with reinforcing straps 20. A compass 22 is secured to the front end of the housing 4 on the top wall 6 by standard means such that by hook-and-loop (VELCRO) fastener 24. The compass 22 allows the user to maintain a certain direction during paddling to reach land or head toward known shipping lanes or search parties.

A thermal protective covering 26 is provided to shelter the user from the extreme elements and thereby increase his chances of survival. The protective covering 26 protects the user from sun exposure and cold temperatures. The protective covering will keep the user's body temperature from becoming too hot or too cold, thereby preventing serious life threatening condition. The protective covering 26 may be made in any shape, as long as it covers at least the user's back and head while the user is paddling in the prone position. For illustrative purposes, the protective covering 26 is disclosed in the shape of a poncho including a pair of sleeves 28, a body portion 30, and a hood 32 with a visor 34. The visor 34 is integral to the thermal protective covering 26 to protect the user from solar radiation and water projected onto user's face. Adjustable quick-release attaching straps 36 made of VELCRO fasteners are provided for removably securing the covering 26 to respective attaching rings 18. The attaching straps 36 allow the user to release the protective covering 26 from the craft 2 when necessary. The straps 36 allow positive coverage of the user's body, preventing wind or wave to blow off the covering.

Reflective patches 38 are provided on the back side of the covering 26 to increase the visibility of the user to a rescuer by visual and instrumental detection. The patches 38 may be made of retro-reflective and IR (infra-red) reflective tape.

Arm straps 40 provide means for adjusting the opening of the sleeves 28 to the size of the user's lower arms. The arm straps 40 enable the user's arms to be comfortably fitted inside the sleeves 28 during paddling. The arm straps 40 are adjustable to permit the thermal protective covering to be fastened and adjusted snugly around the user's arms.

The protective covering 26 is reversible with one side being brightly colored to increase the user's visibility to a rescuer and the other side being dull when visibility is not required. A clip 42 removably secures the covering 26 to the attaching ring 18 when the covering 26 is in a stowed position, generally indicated at 44, as best shown in FIG. 1. The protective covering 26 is rolled up and takes the form generally indicated at 44 when not in use.

A passive signaling device 46 is disposed in a stowed position at the rear end of the craft 2. The signaling device 46 is secured by attaching cords 48 secured to the attaching ring 18, as best shown in FIG. 1. The signaling device 46 deploys into a long streamer adapted to float on the water. The streamer is brightly colored to attract the attention of the rescuer. An example of the signaling device 46 is disclosed in U.S. Pat. No. 5,421,287, which is incorporated herein by reference. A cover 50 keeps the signaling device 46 in its stowed position. The cover 50 is provided with a VELCRO fastener 52. A strap 54 allows for easy lifting of the cover 50 when deploying the signalling device 46.

An accessory package 56 is disposed at the rear end portion of the housing 4. The package 56 contains a gas cylinder 58 operably connected to an inlet valve 60 of the housing 4. An operating lever 62 provides for release of the pressurized gas into the interior of the housing 4 for quick inflation. The operating lever 62 is operatively connected to a valve (not shown) which may be water-activated for dispensing the compressed gas cylinder upon contact with water in case the user is injured or incapacitated. The package 56 also contains a hand pump 64 as a back-up or supplement to the compressed gas inflation and to provide for periodic re-inflation of craft upon partial pressure loss. The package also contains a patch kit 66 to enable the user to make emergency repair to any tear or breaks in the housing 4. The housing 4 is provided with a relief valve 68 to advantageously ensure that the craft does not rapture from too much pressure from over inflation from the gas cylinder 58 or from differential temperatures shrinkage. A cover 70 protects the contents of the package 56 when not in use.

A leash 72 with an ankle strap 74 is secured to the attaching ring 18 and to the user's foot. The leash 72 insures that the craft 2 does not become accidentally separated from the user due to a large wave, a gust of wind or any other outside influence.

The top and bottom walls 6 and 18 are connected to each by a plurality of a nylon strings 76 distributed throughout the interior surfaces of the top and bottom walls. The strings 76 act as spacers between the top and bottom walls 6 and 8 such that when the housing 4 is inflated to high pressure, the top and bottom walls maintain relatively flat and parallel surfaces, without bulging. The strings 76 allow the inflated craft to be extremely rigid when inflated with air. A relatively flat upper and lower walls 6 and 8 are required to make the craft stable in water and provide a comfortable supporting surface for the user.

Figure 4A:
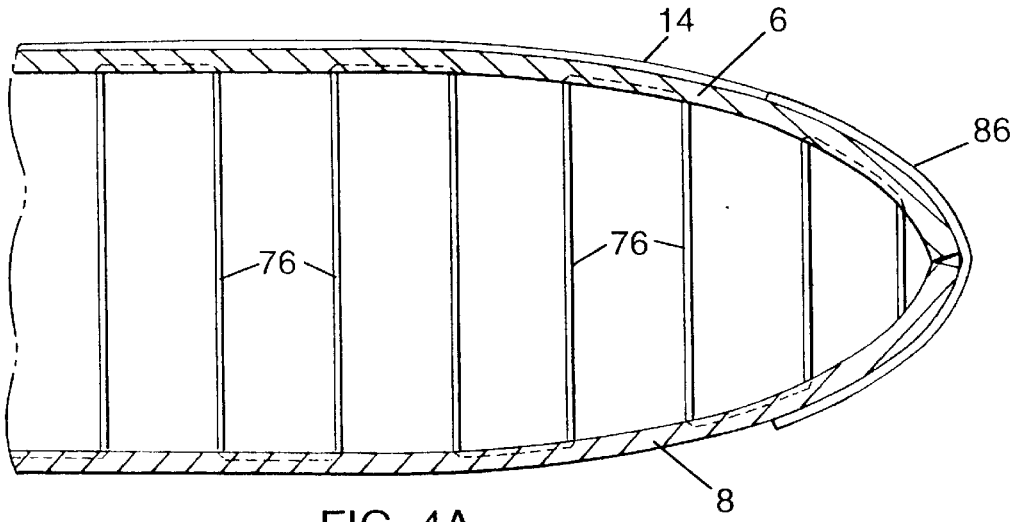
FIGS. 4A, 4B and 4C are fragmentary cross-sectional views taken along line 4—4 in FIG. 2A, showing internal structures of the craft.
Figure 4B:
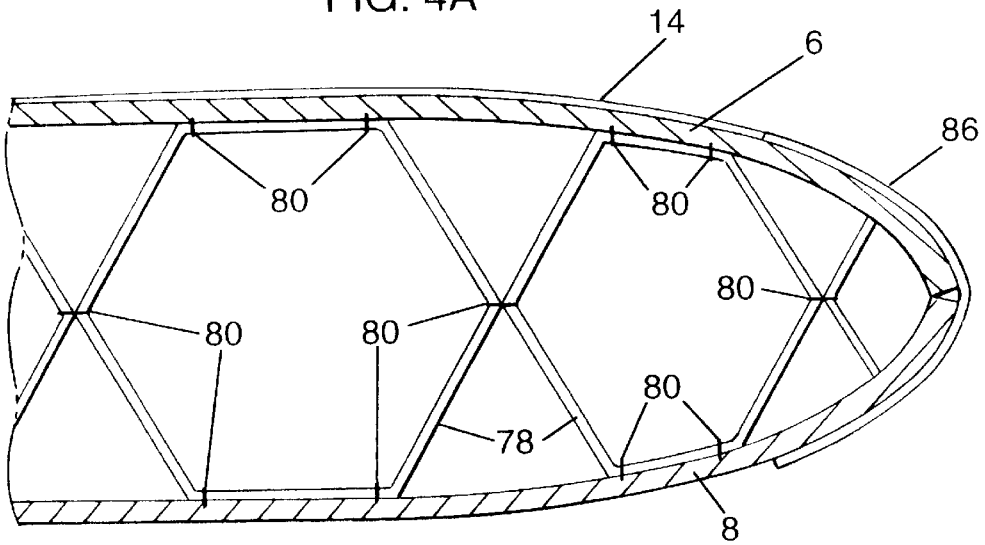

A honeycomb structure 78 may be used in lieu of the nylon strings 76, as best shown in FIG. 4B. The honeycomb structure 78 may be in the form of short sleeves distributed throughout the interior volume of the housing 4. Each honeycomb structure would be in fluid communication with each other so that only a single inlet valve would be needed to inflate the craft. Stitching 80 or any other standard means may be used to secure the honeycomb structure 78 to the top and bottom walls 6 and 8 and to adjacent honeycomb structure.

Figure 4C:
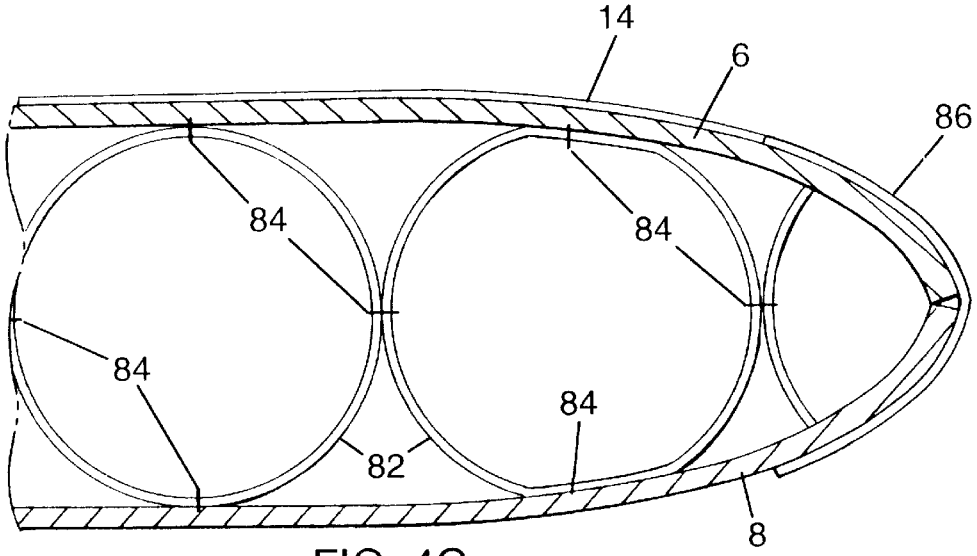

Tubular structure 82 may also be used instead of the nylon string 72 or the honeycomb structure 78, as best shown in FIG. 4C. The tubular structure may be in the form of short sleeves distributed throughout the interior volume of the housing 4. Stitching 84 or other standard means may be used to secure the tubular structure 82 to the top and bottom walls 6 and 8 and to adjacent tubular structure. Each tubular structure would be in fluid communication with each other so that only a single inlet valve would be needed to inflate the craft.

It should be understood that the above discussed internal structures are connectors, since they connect the top and bottom walls together. Any other internal structure would be sufficient that will enable the craft to be inflated to high partial pressures to provide a rigid support platform for the user and maintain the top and bottom walls 6 and 8 relatively flat and parallel to each other.

A seal tape 86 may be used to secure the top and bottom walls 6 and 8 at their peripheral edges. Heat sealing the outer edges the walls 6 and 8 may be also used.

Figure 5A:
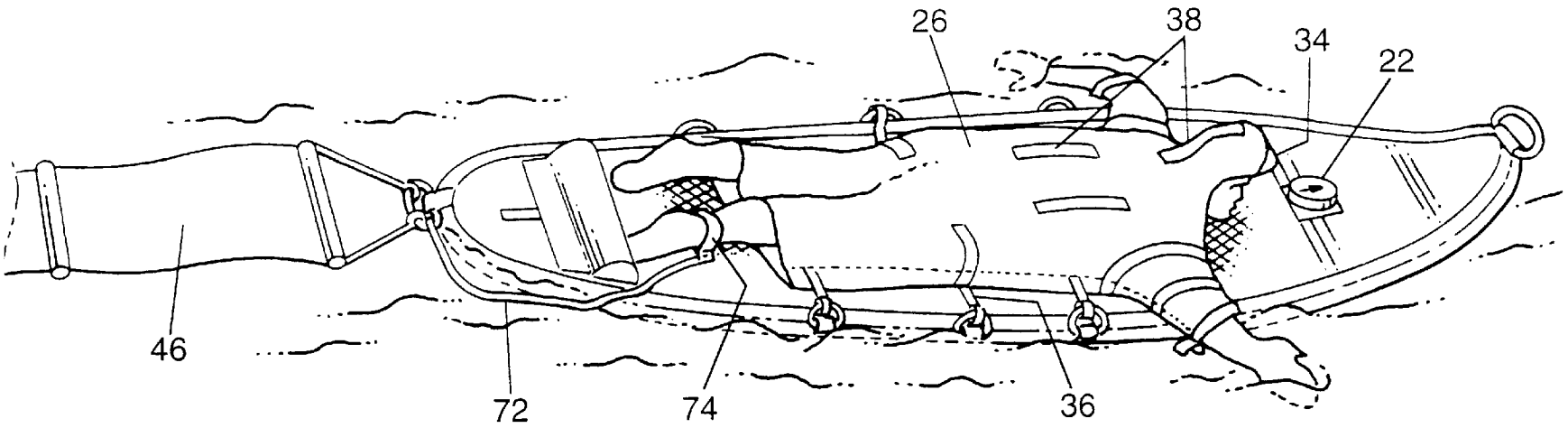
FIGS. 5A and 5B are perspective views of the craft of FIG. 1 shown deployed on water with a user lying prone on top.
Figure 5B:
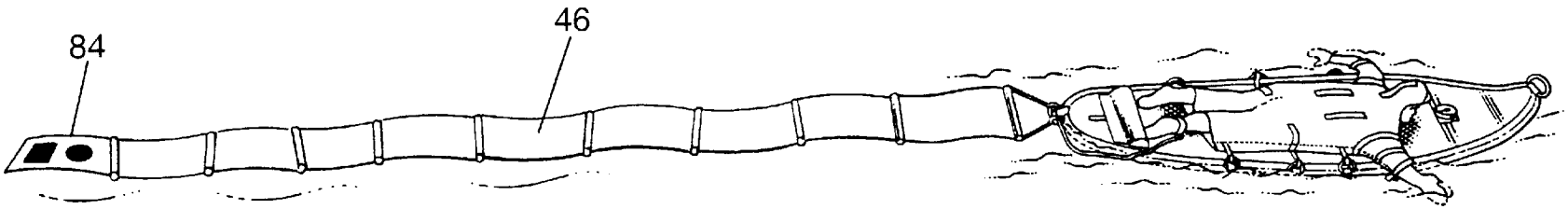

The survival water craft 2 is disclosed deployed in FIG. 5A on a body of water with the user laying on top of the housing 4. The width of the housing 4 is such that the user is able to alternately paddle with his hands to propel the craft forward. The thermal covering 26 is shown being used to protect the user's body and head from life-threatening elements. The reflective patches 38, which have retro reflective and infrared reflective properties, provides for visual and instrumental detection by search parties. The visor 34 protects the user from solar radiation and water projected onto the user's face. The arm straps 40 permit the thermal protective covering 26 to be fastened and adjusted snugly to the user. The attaching straps 36 may be adjusted to adjust the fit of the protective covering on the user and to permit the user to leave the craft 2 if required. The signaling device 46 provides a continuous passive emergency signal to enable search parties to locate the survivor. The signaling device 46 has the international distress signal 88 on an end portion of the streamer.

Figure 6A:
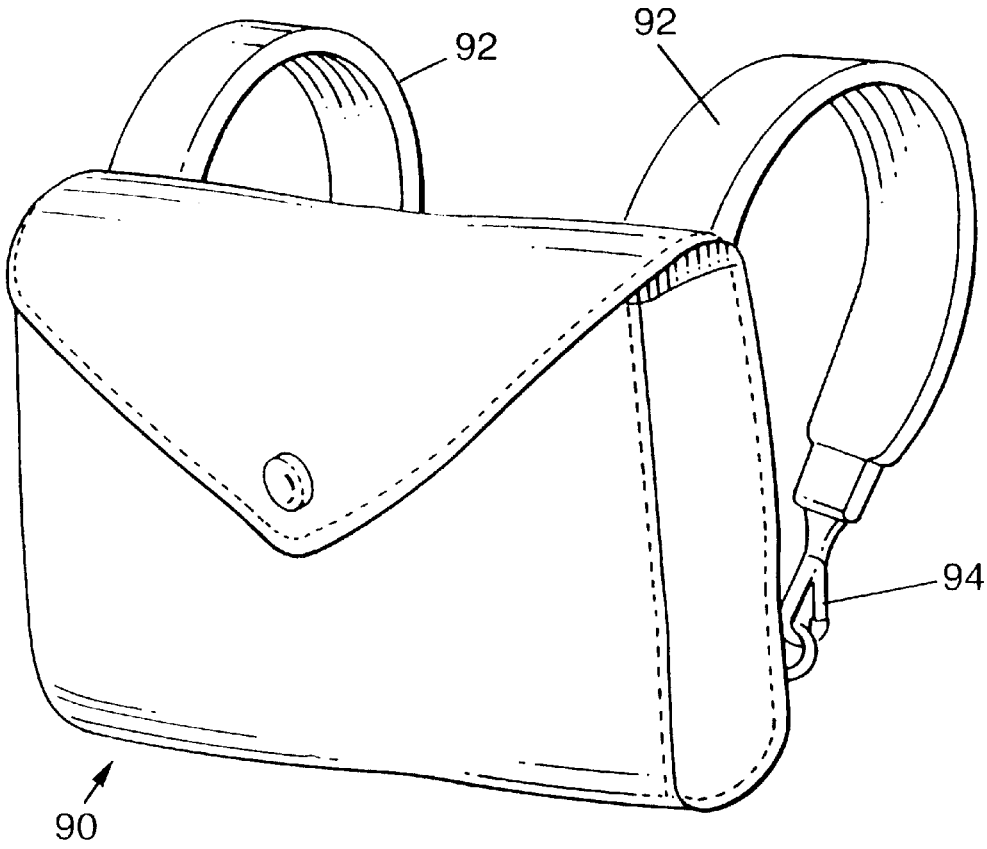
FIG. 6A is a perspective view of a container for the craft of FIG. 1 when deflated and stowed.

The survival craft 2 may be stowed inside a pack 90, as best shown in FIG. 6A. The pack 90 includes straps 92 that can be worn around a user's shoulders. The straps 92 may be also worn around the user's waist by unhooking the straps 92 from the clips 94. The clip 90 can also be attached to a vehicle such as boat or aircraft. The pack may be constructed with water-soluble adhesive such that pack will open upon hitting the water to allow the craft 2 to deploy automatically when the gas cylinder valve is activated by the water.

Figure 6B:
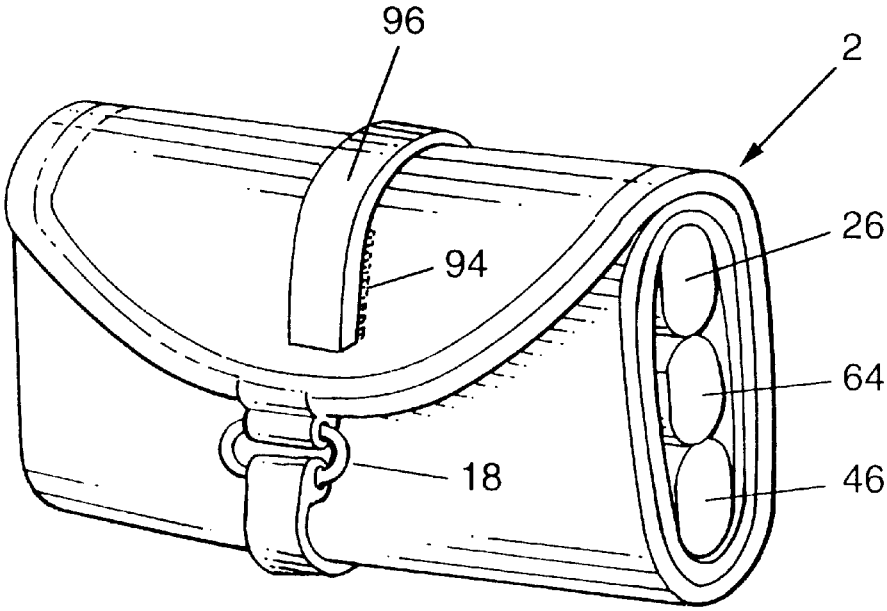
FIG. 6B is a perspective view of the craft of FIG. 1 in the folded and stowed form.

The survival craft 2 is in a folded form when in the stowed position, as best shown in FIG. 6B. The folded craft 2 is stowed within the pack 90. A strap 96 is secured to the front attaching ring 18 and is wrapped around the deflated craft 2 and secured with a fastener 94, such as a VELCRO fastener. The fastener 94 may be water soluble to permit automatic deployment of the craft 2 when it hits the water.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A water craft, comprising:

a) an inflatable elongate housing including substantially parallel top and bottom walls, said top wall including a flat surface configured to support a user lying in a prone face-down position;

b) said housing including a front portion, said top and bottom walls at said front portion remaining substantially parallel while extending upwardly with respect to the water level; and c) said housing being configured such that a user in the prone face-down position can paddle alternately with his hands toward a direction.

2. A water craft as in claim 1, and further comprising:

a) a covering removably secured to said housing, said covering being configured to cover the body of the user.

3. A water craft as in claim 1, and further comprising:

a) means for keeping said top and bottom walls from bulging when said housing is inflated.

4. A water craft as in claim 1, and further comprising:

a) a plurality of threads joining said top and bottom walls to each other.

5. A water craft as in claim 1, further comprising:

a) a plurality of honeycomb structures disposed within said housing and secured to said top and bottom walls.

6. A water craft as in claim 1, and further comprising:

a) a plurality of tubular structures disposed within said housing and secured to said top and bottom walls.

7. A water craft as in claim 1, wherein:

a) said top surface includes a layer of non-skid material.

8. A water craft as in claim 2, wherein:

a) said covering includes arm and body portions.

9. A water craft as in claim 2, wherein:

a) said covering includes a hood.

10. A water craft as in claim 9, wherein:

a) said hood includes a visor.

11. A water craft as in claim 1, and further comprising:

a) a water activated gas cylinder operably connected to said housing.

12. A water craft as in claim 1, and further comprising:

a) a streamer configured to float on water and secured to an end portion of said housing.

13. A water craft as in claim 1, and further comprising:

a) a pack held together by water soluble adhesive;

b) said housing is in a rolled-up position prior to deployment; and c) said housing is disposed within said pack.

14. A water craft, comprising:

a) an inflatable elongate housing including top and bottom walls;

b) said top wall including a non-skid flat surface configured to support a user in a prone face-down position;

c) said housing including a front portion, said top and bottom walls at said front portion remaining substantially parallel while extending upwardly with respect to the water level; and d) said housing being configured such that the user lying in the prone face-down position on said flat surface can paddle alternately with both hands toward a direction.

15. A water craft as in claim 14, and further comprising:

a) a fin or multitude of fins Ry disposed underneath said housing.

16. A water craft as in claim 14, wherein:

a) said top and bottom walls include peripherical edge portions; and b) means for joining said edge portions together.

17. A water craft as in claim 14, and further comprising:

a) a leash Ry operably secured to said housing and for being secured to a body part of the user.

18. A water craft as in claim 14, and further comprising:

a) a compass disposed on said top wall visible to the user in the prone position face-down position.

19. A water craft as in claim 14, and further comprising:

a) a covering removably secured to said housing, said covering being configured to cover the body of the user.

20. A water craft as in claim 14, and further comprising:

a) a streamer configured to float on water and secured to an end portion of said housing.

21. A water craft, comprising:

a) an inflatable housing including top and bottom walls having opposing inner surfaces;

b) said housing including a front portion, said top and bottom walls at said front portion remaining substantially parallel while extending upwardly with respect to the water level;

c) said top wall including a flat surface configured to support a user; and d) a plurality of connectors secured to said inner surfaces, said connectors being configured to maintain said top and bottom walls substantially flat when said housing is inflated.

22. A water craft as in claim 21, wherein:

a) said connectors include a plurality of threads.

23. A water craft as in claim 21, wherein:

a) said connectors include a plurality of honeycomb structures.

24. A water craft as in claim 21, wherein:

a) said connectors include a plurality of tubular structures.

25. A water craft as in claim 21, wherein:

a) said top and bottom walls include peripherical edge portions; and b) a seal tape operatively secured to said edge portions to join said edge portions together.

26. A water craft as in claim 14, and further comprising:

a) a relief operably associated with said housing.

27. A water craft, comprising:

a) an inflatable elongate housing including substantially parallel top and bottom walls, said top wall including a flat surface configured to support a user lying in a prone face-down position;

b) said housing being configured such that a user in the prone face-down position can paddle alternately with his hands toward a direction;

c) said housing being in a rolled-up position prior to deployment;

d) a strap disposed around said housing in said rolled-up position; and e) said strap including water soluble fastener.

* * * * *

US006066016C1

(12) EX PARTE REEXAMINATION CERTIFICATE (9941st)

United States Patent
Yonover

(10) Number: US 6,066,016 C1
(45) Certificate Issued: Nov. 15, 2013

(54) INFLATABLE TRANSPORTABLE WATER CRAFT FOR SURVIVAL OR RECREATIONAL APPLICATIONS

(75) Inventor: Robert N. Yonover, Honolulu, HI (US)

(73) Assignee: Hawaii Airboards, L.L.C., Kailua, HI (US)

Reexamination Request:
No. 90/012,646, Sep. 14, 2012

Reexamination Certificate for:

| | |
|---|---|
| Patent No.: | **6,066,016** |
| Issued: | **May 23, 2000** |
| Appl. No.: | **09/187,732** |
| Filed: | **Nov. 9, 1998** |

Related U.S. Application Data

(60) Provisional application No. 60/065,162, filed on Nov. 12, 1997.

(51) Int. Cl.
*B63B 35/58* (2006.01)

(52) U.S. Cl.
USPC ..... 441/40

(58) Field of Classification Search
USPC ..... 441/40
See application file for complete search history.

(56) References Cited

To view the complete listing of prior art documents cited during the proceeding for Reexamination Control Number 90/012,646, please refer to the USPTO's public Patent Application Information Retrieval (PAIR) system under the Display References tab.

*Primary Examiner* — Matthew C. Graham

(57) ABSTRACT

A water craft for survival or recreational purposes, comprises an inflatable elongate housing that provides a platform and has an internal supporting structure for rigidity and a fin or multitude of fins Ry for stability and tracking purposes as the survivor paddles the water craft by arm motion. The craft is stowed in a compact pouch when not in use and inflated by compressed gases and/or a manual hand pump to sustain the requisite partial pressures of the inflatable water craft. A thermal protective covering with brightly colored pigmentation and retro-reflective and IR-reflective surfaces is provided to protect the survivor from the elements and enhance his visibility. A non-skid surface on the platform enables the survivor to lay on top of the water craft without slipping off. A bright orange colored elongate SEE/RESCUE (trademark) streamer is provided with the water craft for continuous passive emergency signaling purposes to enable search parties to locate the survivor. An attachable leg leash is provided to keep the water craft from separating from the survivor in rough seas and/or wind conditions. A compass is built into the craft to provide direction to the survivor's mobility. In addition to survivor applications, the water craft can be used for water recreational purposes, such as surfing and paddling.

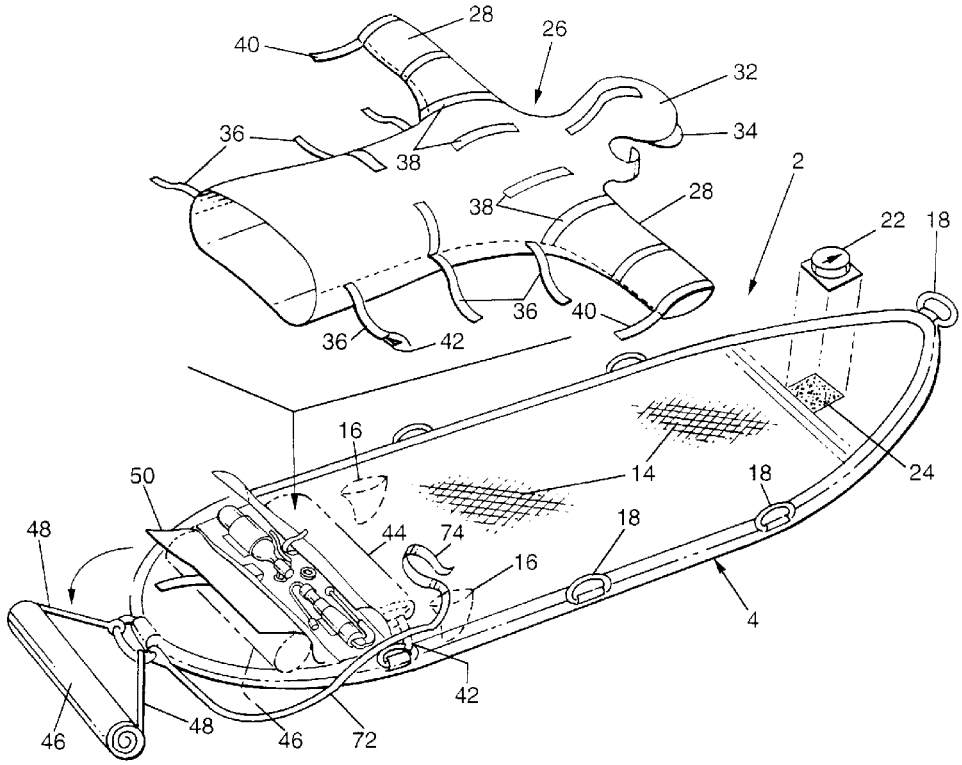

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 7 and 15 are cancelled.

Claims 1, 4, 6, 14, 16, 17, 21, 22 and 25 are determined to be patentable as amended.

Claims 2, 5, 6, 8-13, 18-20, 23, 24, 26 and 27 were not reexamined.

1. A water craft, comprising:

[a)] an inflatable elongate housing including substantially parallel top and bottom walls, said top wall including a *non-skid* flat surface configured to support a user lying in a prone face-down position, *said top and bottom walls further having opposing inner surfaces;*

*a plurality of connectors secured to said inner surfaces, said connectors being configured to maintain said top and bottom walls substantially flat with an uninterrupted planar surface when said housing is inflated, resulting in a stable, rigid support platform;*

*a fin disposed underneath said housing*;

[b)] said housing including a front portion, said top and bottom walls at said front portion remaining substantially parallel while extending upwardly with respect to the water level, *said front portion terminating in a forward, generally pointed end*; and

[c)] said housing being configured such that a user in the prone face-down position can paddle alternately with his hands toward a direction.

4. A water craft as in claim 1, and further comprising:

[a)] a plurality of threads joining said top and bottom walls to each other.

6. A water craft as in claim 1, and further comprising:

[a)] a plurality of tubular structures disposed within said housing and secured to said top and bottom walls.

14. A water craft, comprising:

[a)] an inflatable elongate housing including top and bottom walls;

[b)] said top wall including a non-skid flat surface configured to support a user in a prone face-down position, *said top and bottom walls further having opposing inner surfaces;*

*a plurality of connectors secured to said inner surfaces, said connectors being configured to maintain said top and bottom walls substantially flat with an uninterrupted planar surface when said housing is inflated, resulting in a stable, rigid support platform;*

*a fin disposed underneath said housing*;

[c)] said housing including a front portion, said top and bottom walls at said front portion remaining substantially parallel while extending upwardly with respect to the water level, *said front portion terminating in a forward pointed shape*; and

[d)] said housing being configured such that the user lying in the prone face-down position on said flat surface can paddle alternately with both hands toward a direction.

16. A water craft as in claim 14, wherein:

[a)] said top and bottom walls include peripherical edge portions; and

[b)] means for joining said edge portions together.

17. A water craft as in claim 14, and further comprising:

[a)] a leash [Ry] operably secured to said housing and for being secured to a body part of the user.

21. A water craft, comprising:

[a)] an inflatable housing including top and bottom walls having opposing inner surfaces;

[b)] said housing including a front portion, said top and bottom walls at said front portion remaining substantially parallel while extending upwardly with respect to the water level, *said front portion terminating in a forward pointed shape;*

*a fin disposed underneath said housing*;

[c)] said top wall including a *non-skid* flat surface configured to support a user; and

[d)] a plurality of connectors secured to said inner surfaces, said connectors being configured to maintain said top and bottom walls substantially flat *with an uninterrupted planar surface* when said housing is inflated, *resulting in a stable, rigid support platform*.

22. A water craft as in claim 21, wherein:

[a)] said connectors include a plurality of threads.

25. A water craft as in claim 21, wherein:

[a)] said top and bottom walls include peripherical edge portions; and

[b)] a seal tape operatively secured to said edge portions to join said edge portions together.

* * * * *